US011536460B2

(12) United States Patent
Masten, Jr.

(10) Patent No.: US 11,536,460 B2
(45) Date of Patent: Dec. 27, 2022

(54) INFRARED RADIANT EMITTER

(71) Applicant: James William Masten, Jr., Everett, WA (US)

(72) Inventor: James William Masten, Jr., Everett, WA (US)

( * ) Notice: Subject to any disclaimer, the term of this patent is extended or adjusted under 35 U.S.C. 154(b) by 210 days.

(21) Appl. No.: 16/925,988

(22) Filed: Jul. 10, 2020

(65) Prior Publication Data

US 2020/0340678 A1 Oct. 29, 2020

Related U.S. Application Data

(63) Continuation of application No. 15/439,902, filed on Feb. 22, 2017, now Pat. No. 10,718,527.

(60) Provisional application No. 62/372,540, filed on Aug. 9, 2016.

(51) Int. Cl.

| | |
|---|---|
| ***H05B 3/10*** | (2006.01) |
| ***H05B 3/12*** | (2006.01) |
| ***H05B 3/28*** | (2006.01) |
| ***F24C 7/08*** | (2006.01) |
| ***H05B 3/74*** | (2006.01) |
| ***F24C 15/10*** | (2006.01) |
| ***H05B 1/02*** | (2006.01) |
| *F24C 7/04* | (2021.01) |

(52) U.S. Cl.

CPC ..... *F24C 7/087* (2013.01); *F24C 15/102* (2013.01); *H05B 1/0266* (2013.01); *H05B 3/748* (2013.01); *F24C 7/046* (2013.01); *H05B 2213/07* (2013.01)

(58) Field of Classification Search

CPC ..... H05B 1/0258–0266; H05B 3/0071–0076; H05B 3/10–12; H05B 3/28–283; F24C 7/067; F24C 7/083; F24C 15/10–102

See application file for complete search history.

(56) References Cited

U.S. PATENT DOCUMENTS

| | | | |
|---|---|---|---|
| 3,987,275 | A | 10/1976 | Hurko |
| 4,002,883 | A | 1/1977 | Hurko |
| 4,237,368 | A | 12/1980 | Welch |
| 4,350,875 | A | 9/1982 | McWilliams |
| 4,393,299 | A | 7/1983 | McWilliams |
| 4,430,558 | A | 2/1984 | McWilliams |
| 4,633,238 | A | 12/1986 | Goessler et al. |
| 4,740,664 | A | 4/1988 | Payne et al. |
| 4,816,647 | A | 3/1989 | Payne |
| 5,041,809 | A | 8/1991 | Payne et al. |
| 5,043,559 | A | 8/1991 | Scott |
| 5,498,854 | A | 3/1996 | McWilliams |
| 5,512,731 | A | 4/1996 | McWilliams |
| 5,565,123 | A | 10/1996 | Wolff |
| 5,699,606 | A | 12/1997 | McWilliams |
| 5,837,975 | A | 11/1998 | Dillard et al. |

(Continued)

OTHER PUBLICATIONS

Microporous Insulation Brochure, Promat (Year: 2012).*

*Primary Examiner* — Michael A Laflame, Jr.

(57) ABSTRACT

An infrared heating apparatus includes a sheet of ceramic glass having a passband in the infrared spectrum, a metal resistive element having a first portion that is covered by a ceramic refractory material and a second portion that is exposed by the ceramic refractory material, and a controller that controls the metal resistive element to emit infrared radiation in a wavelength corresponding to the passband of the ceramic glass.

18 Claims, 11 Drawing Sheets

(56) References Cited

U.S. PATENT DOCUMENTS

| | | | | |
|---|---|---|---|---|
| 5,908,571 | A | 6/1999 | Scott | |
| 6,111,228 | A | 8/2000 | Berkcan et al. | |
| 6,133,552 | A | 10/2000 | Saulnier et al. | |
| 6,169,486 | B1 | 1/2001 | Berkcan et al. | |
| 6,285,012 | B1 | 9/2001 | Connolly et al. | |
| 6,462,316 | B1 | 10/2002 | Berkcan et al. | |
| 6,492,627 | B1 | 12/2002 | Ensinger et al. | |
| 6,538,238 | B1 | 3/2003 | Berkcan et al. | |
| 6,864,465 | B2 | 3/2005 | Berkcan et al. | |
| 6,875,957 | B2 | 4/2005 | Taplan et al. | |
| 6,924,468 | B2 | 8/2005 | Abbott et al. | |
| 7,183,522 | B2 | 2/2007 | Irrera et al. | |
| 7,923,969 | B2 * | 4/2011 | Murao ..... | H02J 7/0016 307/49 |
| 2001/0003335 | A1 * | 6/2001 | Griffiths ..... | H05B 3/746 219/448.11 |

* cited by examiner

From Patent 5,512,731

INFRARED RADIANT EMITTER

CROSS REFERENCE TO RELATED APPLICATIONS

The present application is a continuation of U.S. patent application Ser. No. 15/439,902, filed Feb. 22, 2017, and issued as U.S. Pat. No. 10,718,527 on Jul. 21, 2020, which claims the benefit of Provisional Application No. 62/372,540, filed Aug. 9, 2016, the disclosures of which are incorporated in their entirety herein by reference.

FIELD OF THE INVENTION

The present invention reveals significant improvements to the method and apparatus for the heating of an object through a smooth ceramic glass surface.

BACKGROUND OF THE INVENTION

Since the development of various ceramic glasses in the 1960's and 1970's, the fundamental feature of extremely low coefficient of expansion has created the opportunity for smooth-top cooking surfaces with heating sources beneath the ceramic glass. Smooth-top cooking surfaces were attractive and practical because they were easy to clean.

Initially, the utilization of conduction heating of the ceramic glass plate, which in turn would heat the cooking utensil through contact conduction, was the only option as the ceramic glasses were largely opaque at all wavelengths. Although the thermal conductivity of the ceramic glass could hardly be classified as "highly thermally conductive" at about 2 Watts/meter-C°, or less than one tenth the thermal conductivity of iron, conduction heating has been nearly universally implemented as the primary method of driving thermal energy through smooth ceramic glass cooktops to cooking utensils.

Techniques implemented when ceramic glass was introduced as a novel technology to the cooktop market were uncomplicated, such as that disclosed in U.S. Pat. No. 3,987,275, which was one of the first disclosures in which the ceramic glass was in physical contact with the heating elements. But techniques evolved quickly, such as that disclosed in U.S. Pat. No. 4,002,883, which employs film elements directly bonded to the ceramic glass.

Placing the heating elements directly in contact with the ceramic glass created opportunities for the elements to provide enough thermal energy to cause the ceramic glass to fail from excessive heat. To manage this situation, manufacturers tried to monitor the temperature of the ceramic glass and limit the thermal energy output of their heating elements as a safety measure.

Many patents were filed relating to monitoring the temperature of the cooktop as a means to control the temperatures of the heating element, the cooktop and the cooking process. Typical of these methods and apparatuses was U.S. Pat. No. 4,237,368, which discloses a method of bonding a thermistor to the ceramic glass in an effort to measure the temperature of the ceramic glass directly. U.S. Pat. No. 4,350,875 was one of the first to disclose a method of using an Inconel rod through a lever to activate a switch when the rod was heated and expanded over the hot radiant element. U.S. Pat. No. 4,430,558 discloses a similar apparatus and method to use an Inconel rod and switch to temperature-limit two radiant elements. U.S. Pat. No. 4,633,238 discloses a method of using a similar Inconel rod to directly activate a switch, eliminating the lever to lower costs.

There are methods and apparatuses to heat the bottom of the ceramic glass using heating elements bonded to the glass, where the heating elements themselves become part of the temperature measurement of the ceramic glass, as in U.S. Pat. No. 5,041,809.

Other U.S. patents, such as U.S. Pat. No. 6,111,228, disclose methods for using optical waveguide apparatuses as a means to capture infrared emissions from the cooktop in an effort to measure the temperature of the cooktop without making physical contact with the ceramic glass.

U.S. patents disclose new methods to control the thermal output of the heating element using analog Pulse Width Modulation, such as U.S. Pat. No. 5,565,123, or even microprocessor-controlled pulse width modulation, such as disclosed in U.S. Pat. No. 4,740,644.

U.S. Pat. No. 4,816,647 reveals microprocessor implemented methods to control the temperature of the ceramic glass, over-riding the user's selected heating rates if the temperatures of the ceramic glass exceeded safe levels.

Observations on the Early Years of the Ceramic Glass Cooktop:

Common to all of the disclosures related to the delivery of thermal energy to the ceramic glass cooktop and the efforts at managing the delivery of thermal energy by directly or indirectly measuring the temperature of the ceramic glass cooktop, is the assumption that the cooktop should be implemented as a conduction conduit for the thermal energy from the heating element to the cooking utensil resting on top of the ceramic glass cooktop.

To this end, all of the disclosures in the above referenced U.S. patents are a continuation of the functional features of the original ceramic glasses of the 1960s and 1970s: including limiting the temperature of the element to approximately 700° C. because the limiting operational temperature of the ceramic glass is 700° C.

The First Evolution:

New ceramic glasses were introduced in the mid-1990s with significant passbands for Infrared energy that exceeded 90% transmission at some wavelengths. U.S. patent disclosures after the development of the new ceramic glass technologies reflected changes in how the heating elements were constructed and used with the ceramic glass. U.S. Pat. No. 5,512,731 discloses a corrugated element that was set away from the ceramic glass. The corrugated element presented an expanded surface area that was largely perpendicular to the ceramic glass.

Still, heating efficiencies were very low and many efforts were made to limit the energy lost by the (resistive) element. The (resistive) element metal was perforated or configured to minimize the anchor attached to the ceramic insulator providing a mechanical mounting base. U.S. Pat. No. 5,699,606 discloses that the discontinuous means of the portion of the (resistive) element that is physically inserted into the mounting base would limit current flow and thus limit the thermal energy lost to conduction within the mounting material. U.S. Pat. No. 5,837,975 discloses a minimization of the amount of heating element material that is inserted into the supporting base, again in an effort to minimize thermal energy loss.

With the advent of the more robust ceramic glass, a corrugated (resistive) element with the major radiant surface set at right angles to the ceramic glass cooktop became nearly universal; but the means of managing the heating elements remained about the same. Various mechanisms were invented that either measured the glass directly or measured the thermal energy released by the heating element; but all measurements still feed a method to control an energy cut-off apparatus when the temperature of the heating source or the ceramic glass approaches the thermal limit of the ceramic glass, about 700° C.

This disclosure identifies four critical issues that were over looked or missing from similar systems in the market place and all related previous patents:

1. The highly transmissive passbands of the newer ceramic glasses are an opportunity to evolve to a more effective and efficient method of driving heat through the ceramic glass using appropriate radiant energy.
2. The wavelengths of the transmission passbands dictate the operating temperatures for the (resistive) radiant element using Wien's Displacement Law.
3. Application of the Stefan Boltzmann Law to the physical implementation of the temperature sensors and the construction of the (resistive) radiant element housing will increase system efficacy.
4. Constructing the (resistive) radiant element as a proper Lambertian Radiator will create a near optimum projected radiant pattern.

The Highly Transmissive Passband:

The introduction of the new generation of ceramic glasses in the mid-1990s should have generated a very large increase in capability and performance. By this time, smooth-top range and cooktop manufacturers had almost universally stopped direct conductive heating of the ceramic glass and implemented non-contact (resistive) radiant elements as their heating sources.

As can be seen in FIGS. 8 and 9, there are two passbands for infrared energy presented by the generation of ceramic glass introduced in the mid-1990s. (FIG. 8 shows transmission characteristics for non-tinted translucent ceramic glass; FIG. 9 shows transmission characteristics for opaque ceramic glass.) The wavelength vs. transmission plots are typical for the ceramic cooktop glasses popular in the marketplace and manufactured by either Schott Glass or Nippon Electric Glass, the two manufacturers which dominate this market space.

The abstracted charts show that the lower passband 420, 520 (low frequency, long wavelength) nominally covers wavelengths from about 3,500 nm to about 4,250 nm. The relationship of wavelength to temperature is given by Wien's Displacement Law:

$$T = \frac{2.898 \times 10^{-3} m \cdot K}{\lambda_{peak}}$$

These lower passband wavelengths correspond to temperatures of approximately 410° C. to 550° C. (about 770° F. to about 1022° F.), which is typical of the currently manufactured systems as reviewed by this inventor.

But as presented in the transmissivity charts, the peak transmissivity for the lower passband is at best 60%, and that is over a narrow portion of the band. This means that at the very best, radiant elements that operate in this lower passband are wasting at least 40% of their energy output as ineffective localized heating.

The upper passband 410, 510 (higher frequency, shorter wavelength) is characterized by wavelengths shorter than 2,700 nm and longer than 500 nm for clear ceramic glasses and for the heavily opaque second generation ceramic glasses from 2,700 nm down to at least 1,900 nm. These passbands, at wavelengths corresponding to temperatures between 800° C. and 1,250° C., are where the transmission of infrared radiant energy is nominally 70% to 90% efficient.

Those above-referenced patents which implemented temperature control of the heating elements of cooktop systems, whether the elements contacted the glass or not, universally disclosed that the upper limit of 700° C. was observed as a safety measure against glass failure.

A Higher Temperature Radiant Element:

The safe operating temperature of the glass should be observed, but the operating temperature of the radiant source should be significantly higher than 700° C. If the radiant source is operating in the upper passband, then the thermal energy transfer efficiency will increase by at least 10% and most probably by more than 30% over the actual operating range of temperatures.

The typical control system as related in the patents that were filed after the mid-1990s, as noted above, cuts off the energizing power to the elements when the energy radiating from the element is measured to approach 700° C.

A radiant source tuned to the lower passband with a maximum transmissivity of about 60% requires 100 Watts of transmitted radiant energy to deliver 60 Watts through the ceramic glass to the cooking utensil. What is worse is that for every 100 Watts of radiant energy directed at the ceramic glass, approximately 40 Watts will be lost to heating the ceramic glass.

Consideration of the transmissivity of the ceramic glass will significantly improve the operating parameters of the smooth ceramic glass cooktop. A radiant source tuned to the upper passband with the radiant transmission power of only 85 Watts will deliver approximately 60 Watts through the ceramic glass to the cooking utensil while only about 25 Watts will be lost to heating the ceramic glass. Both the overall reduction in power and the reduced loss into the ceramic glass improve the efficacy of the system. The ceramic glass can operate in the cooking zone longer and not get heated to the point of creating a safety concern. Overall energy is saved and operational costs are reduced.

The Stefan-Boltzmann Environment:

As noted above, there are several U.S. patents which have as a focus the improvement in the efficiency of the (resistive) radiant element. There were efforts patented that minimized the portion of the (resistive) element that was used to anchor the (resistive) element to the ceramic base.

In light of the Stefan-Boltzmann Law the concerns were unwarranted. The insulating refractory base used for providing physical mounting for the (resistive) element has a very low thermal conductivity and a very high thermal capacity. As such, the refractory in contact with the (resistive) element will quickly heat up and minimize the flow of thermal energy because the (resistive) element and the refractory anchor will quickly reach an equilibrium temperature.

In contrast are the attempts at measuring the temperature of the ceramic glass using attached but unshielded thermistors, unshielded contact sensors or optical waveguide temperature sensors. All of these considerations are confounded by the incorrect assumptions made relative to the use of a radiant energy sensor in the presence of the high-output radiant energy source (i.e., the (resistive) element) as compared to the energy emitted from the bottom of the ceramic glass plate.

The Stefan-Boltzmann Law defines the effectiveness of the radiant energy transfer as proportional to the $4^{th}$ power of the difference in temperature. Given the Stefan-Boltzmann Law, any of these techniques to monitor the temperature of the bottom of the ceramic glass plate will be confused by the dominance of the high-temperature source.

Additionally, all "temperature" sensors measure "intensity" and not "power," and as such they cannot differentiate between reflected, transmitted or radiated energy. Although the ceramic glass plate is only about 60% transmissive at 700° C., the optical characteristics of the ceramic glass would enable the "apparent" transmission of the radiant energy as indicated by the observed "intensity" through the ceramic glass. Thus optical sensors can be confused by their inability to quantify observed "power" and these sensors always find the highest temperature in their field of view, which could be a reflection of the radiant source.

An apparatus such as that disclosed in U.S. Pat. No. 6,111,228, using waveguides to "look" at the ceramic glass and duct radiant energy to an optical sensor, is unlikely to yield a reliable measure of the ceramic glass, because the higher temperature of the radiant source could be transmitted through the glass to the waveguide or reflected from the glass to the waveguide, dominating (by the fourth power of the difference) the lower-temperature radiant energy of the cooler ceramic glass plate.

Lambertian Radiators:

Lambert's cosine law defines how radiant energy leaves an emitting surface. All radiant surfaces that are not curved for some finite length are Lambertian Radiators. The corrugated (resistive) elements of the apparatus of several of the patents mentioned above are all mounted orthogonal to the ceramic glass underside, FIG. 7, 720. Unfortunately, these elements were constructed with their major surfaces placed at 90 degrees to the bottom of the cooktop. FIG. 7, with inset "FIG. 1" 740 excerpt from U.S. Pat. No. 5,512,731, shows the typical construction of the ribbon element in typical contemporary application. Blow up 730 reveals an enlarged view of the radiant surfaces of the (resistive) ribbon element. The large surfaces of the (resistive) ribbon element 710, 720 are placed at 90 degrees to the cooktop so that a very minimal amount of radiated energy is directly exposed to the bottom of the cooktop, as disclosed in U.S. Pat. No. 5,512,731 and others referenced above.

In fact, the only surface positioned so that it can directly radiate to the cooktop is the small edge of the (resistive) ribbon 700 which is at most approximately one tenth of the exposed surface area of the (resistive) radiant ribbon 730, leading to at best no more than 7% of the radiant output directed towards the ceramic glass cooktop with any potential to pass through the glass to the cooking utensil 3. Thus, the chief mechanism for heating from this type of thermal source is hot-air convection, which heats the glass plate and other supporting structures as a means to heat the cooking utensil on top of the glass plate.

These systems in manufacture and service over most of the world today are heating the bottom of the ceramic glass by convection air processes as the segments of the (resistive) radiant elements face each other over a significant portion of their length. As defined by the Stefan-Boltzmann law, the elements of equal temperatures will not effectively transmit energy to each other, but they will dramatically heat the air between them.

A radiant element operating as an effective Lambertian Radiator will project more than 70% of the total radiant energy emitted from the radiant element within a 45 degrees cone normal to the radiant surface.

SUMMARY OF THE INVENTION

This invention comprises a method and apparatus to exploit the more efficient of the infrared passband characteristics of ceramic glass to transmit thermal energy through the ceramic glass to a receiver, while not overheating the ceramic glass. This disclosure reveals the implementation of a wavelength tunable radiant emitter capable of creating appropriate infrared wavelengths and efficiently projecting the radiant energy through an infrared-transmissive physical barrier of ceramic glass. Transmitting radiant energy of the appropriate wavelength through the ceramic glass significantly improves the rate and efficiency of heating the thermal target on the other side of the ceramic glass while reducing the wasteful heating of the ceramic glass.

The apparatus is a low-cost (resistive) radiant element that is physically constructed to have a natural beam pattern that makes it a nearly ideal Lambertian Radiator and, as such, projects more than 70% of the total radiant output in a 45° cone normal to the radiating surface. The apparatus includes a shielded means of directly and unambiguously measuring the temperature of the radiant element and the ceramic glass.

This apparatus is implemented by a method that monitors and manages the effective operation of the (resistive) radiant element and protects the ceramic glass from thermally induced failure.

BRIEF DESCRIPTION OF THE DRAWINGS

The foregoing aspects and many of the attendant advantages of this invention will become more readily appreciated as the same becomes better understood by reference to the following detailed description of a preferred embodiment (use of the radiant emitter as a heating element in a cooking range, with the ceramic glass surface utilized as a smooth cooktop surface), when taken in conjunction with the accompanying drawings, wherein.

ITEM #DESCRIPTION

Figure 1:
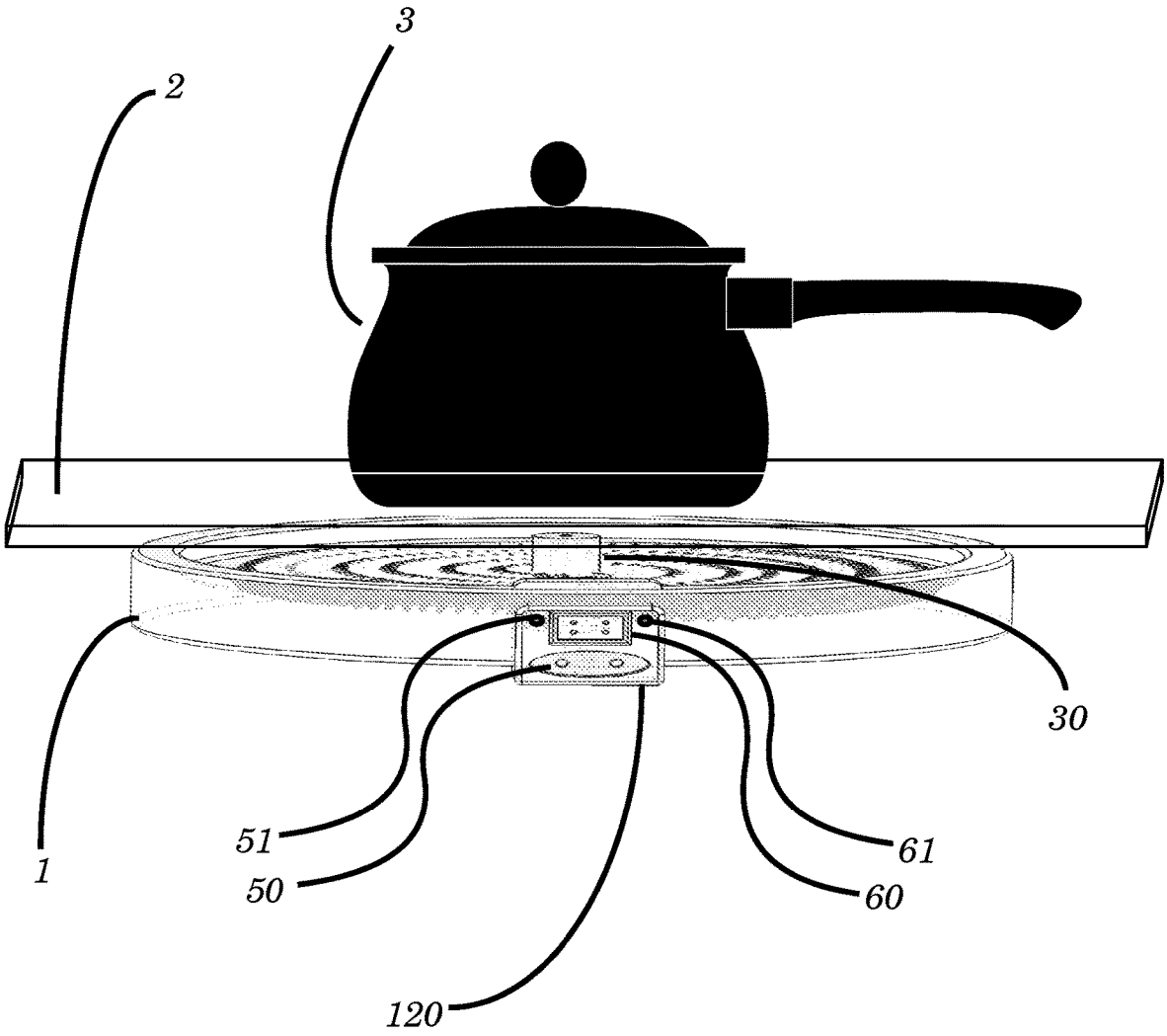
FIG. 1 is an illustration of the preferred embodiment of the tunable, high temperature radiant element, shown in relation to a portion of a ceramic glass cooktop, surmounted by an example cooking utensil.

1 Radiant cooking element unit
2 A portion of a ceramic glass cooktop
3 An example cooking utensil

10 The cast and machined ceramic refractory radiant element shell
20 Indicates the embedded (resistive) radiant element
30 The ceramic refractory shield that is protecting the ceramic glass thermocouple sensor
40 The contact point between thermocouple sensor 134 and ceramic glass 2
50 The connector to supply AC power to the radiant element
51 Signal LED
60 The connector to provide communications to the control computer and the user interface
61 Signal LED
70 Castable refractory in which (resistive) radiant element is embedded
120 The embedded controller and switch (control module)
130 Machined ceramic refractory providing a thermal barrier for the embedded controller
132 Inconel-shielded thermocouple and leads that measure the temp of the (resistive) element 20
134 Inconel-shielded thermocouple and leads of the sensor monitoring the ceramic glass plate 2
140 Point of contact between the thermocouple 132 and the (resistive) element 20 embedded in 1
150 Calls out the spring used to push ceramic shield 30 to contact the ceramic glass plate 2
160 The machinable ceramic insulation that isolates the Inconel spring.
165 Grooves—area where material has been relieved from machined ceramic 10 creating pocket for (resistive) element 20 and castable ceramic 70
200 Indicates the cut-out revealing the embedded thermocouple (resistive) element connection
300 Points out one of the AC leads of the (resistive) element
310 Points out the other AC lead of the (resistive) element
410 Identifies the upper and highly transmission passband for an example second generation non-tinted translucent Ceramic Glass
420 Identifies the lower and less transmission passband currently used by industry
510 Identifies the upper and highly transmission passband for $2^{nd}$ generation opaque Ceramic Glass
520 Identifies the lower and less transmission passband currently used by industry
550 Callout for detail of the exposed portion of coil of (resistive) emitter 20
560 Indicates radiant energy emitted 90 degrees to the surface of emitter 20
565 Exposed portion of coil of (resistive) emitter 20
580 Indicates thermal emission normal to the inner surface of (resistive) emitter 20
590 Indicates reflected energy, all of which is normal to surface of castable ceramic 70

DETAILED DESCRIPTION OF THE INVENTION

The following detailed description of a preferred embodiment of the present invention proceeds with reference to the delivery of thermal energy to a cooking utensil sitting on top of a second generation ceramic glass plate as provided by either of the two major manufacturers after the mid-1990s.

The following description of the present invention is in the context of a preferred embodiment comprising a radiant emitter heating element 1, smooth top ceramic glass cooktop 2, and utilizing a common cooking utensil 3. The combined system is intended to be heated by a uniquely configured radiant emitter element 1 optimized to deliver radiant energy through the ceramic glass 2 to the cooking utensil 3 sitting on top of the ceramic glass.

The basic apparatus disclosed herein is not intended to be limited to smooth top cooktop configurations, and in fact could be used to source the precise control of thermal energy from a (resistive) radiant emitter in a different configuration from the (resistive) radiant element designed for the cooktop application. There are many configurations for a (resistive) radiant emitter optimally designed to transmit through a ceramic glass physical barrier for a multitude of purposes including cooking, baking in an oven with ceramic glass walls, chemical reduction, curing of coatings and/or adhesives, and most any other thermo-physical application, including gasification of hydrocarbons and even the heat treatment of non-ferrous metals or the melting and flowing of non-ferrous metals, or even for various treatments of metals or minerals including the reclamation of contaminated soils. It should be understood that this aspect of the present invention is not limited to the apparatus described herein. Practice of the process or apparatus described below for heating objects with the radiant emitter through ceramic glass is considered to be within the scope of the present invention.

Figure 2:
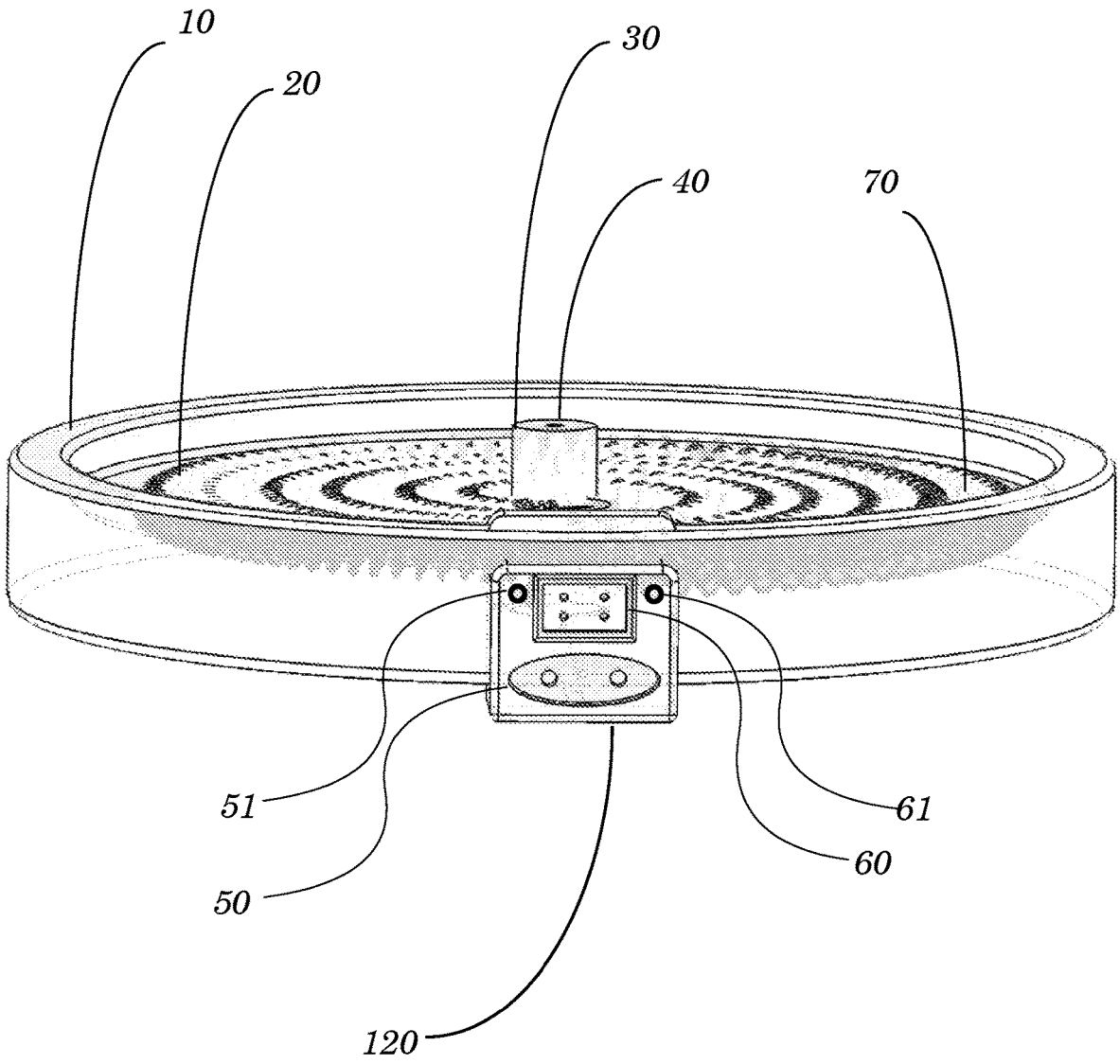
FIG. 2 is a view of the entire tunable, high temperature radiant element.

FIGS. 1 and 2 depict general views of one embodiment of an apparatus, while FIGS. 3 through 7 show some of the details of the apparatus, showing the design and construction of the new infrared emitters configured as (resistive) radiant elements 1 for this invention, which incorporate a coiled resistive wire (e.g., nickel chromium) utilizing relatively small coils 20 with a coil diameter of 12 to 17 wire diameters. These coils 20 are set inside a ceramic refractory 70 that is "cast" with the coils mostly submerged into the ceramic refractory, such that only a length of wire equal to approximately 12 to 17 diameters of the wire is exposed to radiate above the common surface of the castable ceramic refractory 70 in an array of evenly spaced and co-aligned arcs. The wire coils are positioned in, and supported by, the ceramic such that the surface tension of the coils overcomes plastic deformation for the selected range of heating.

Figure 4:
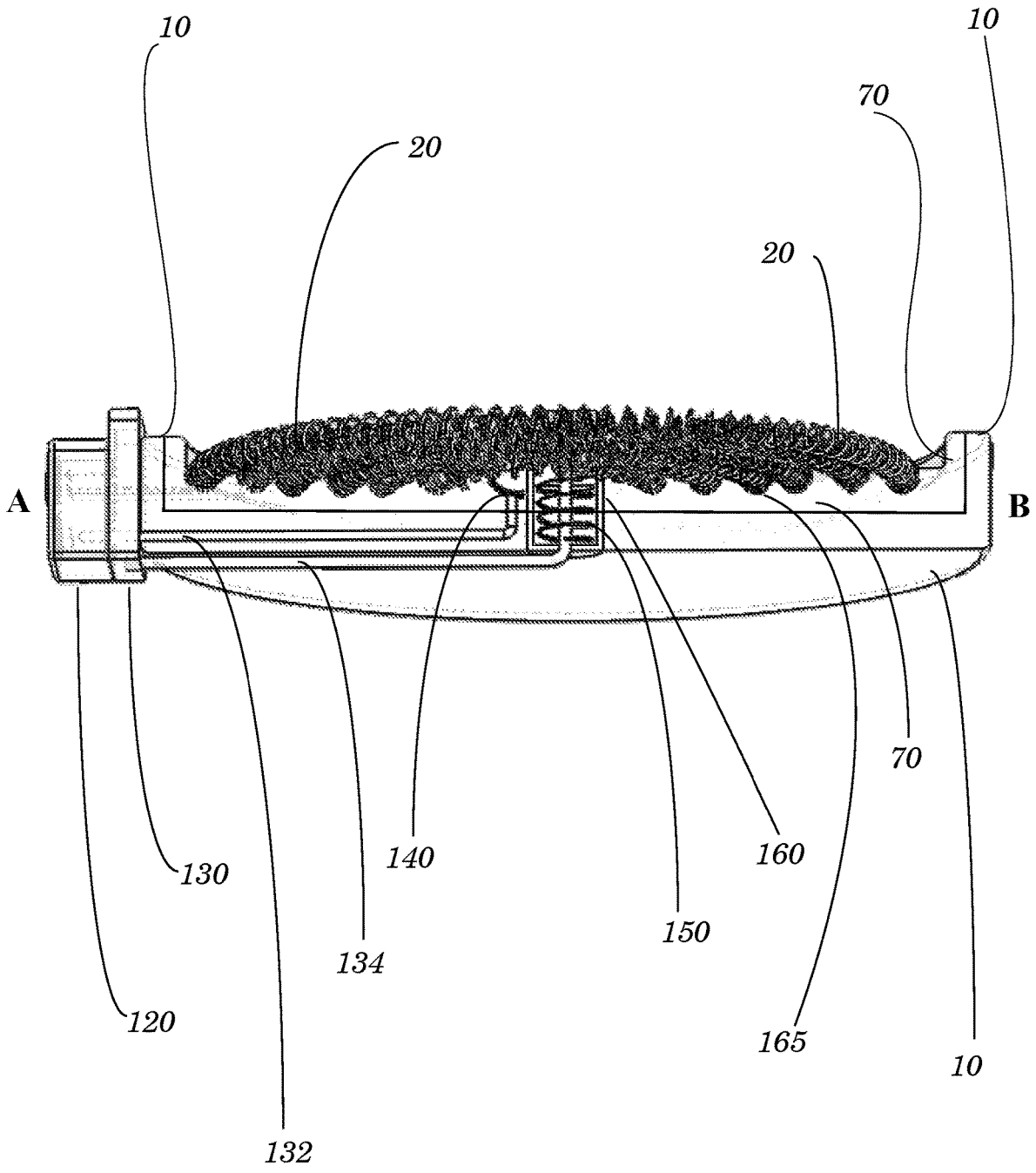
FIG. 4 is a view taken along line A-B in FIG. 3.
Figure 5:
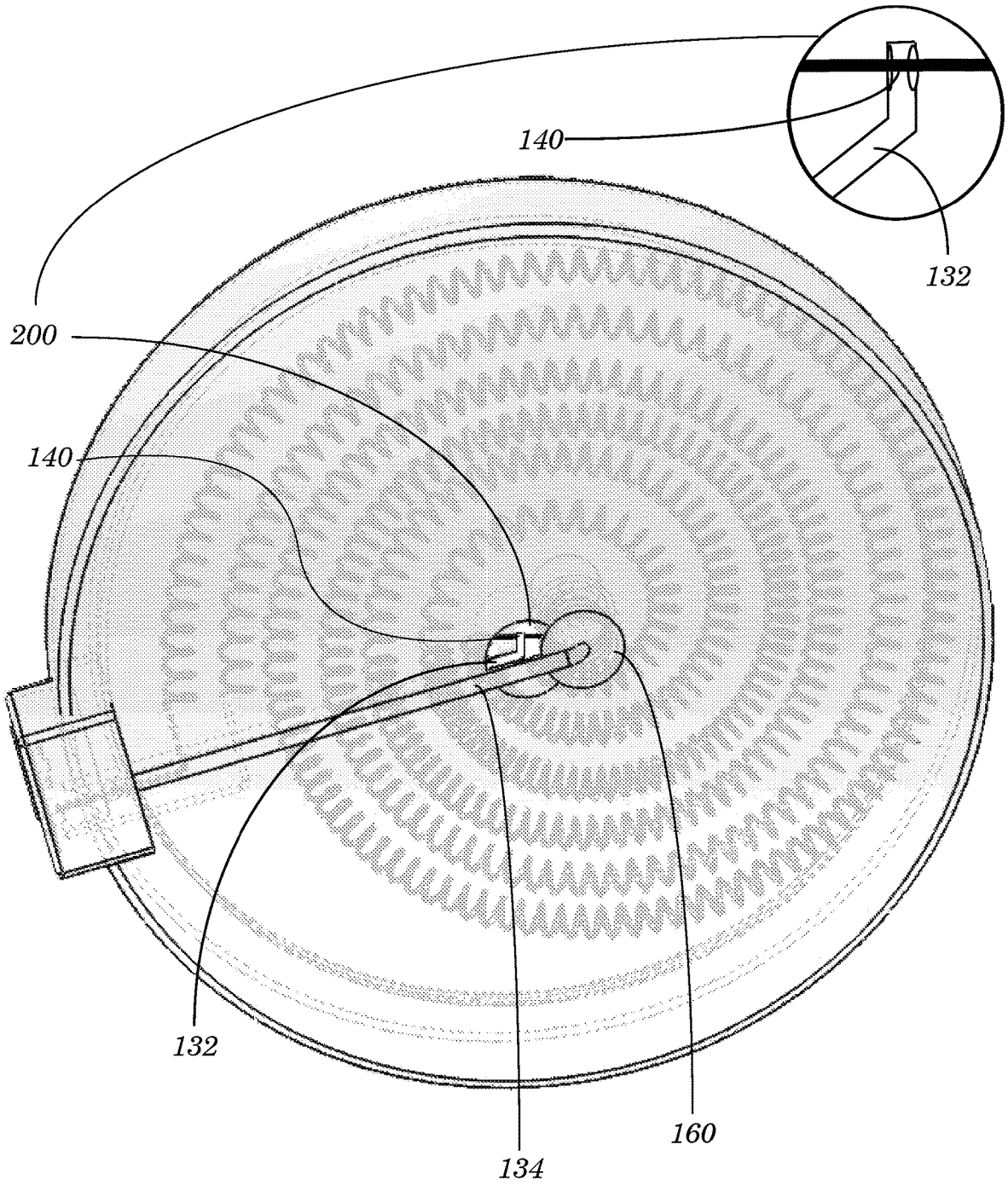
FIG. 5 is a view of the bottom of the radiant element with a reveal cut out, item 200.
Figure 6:
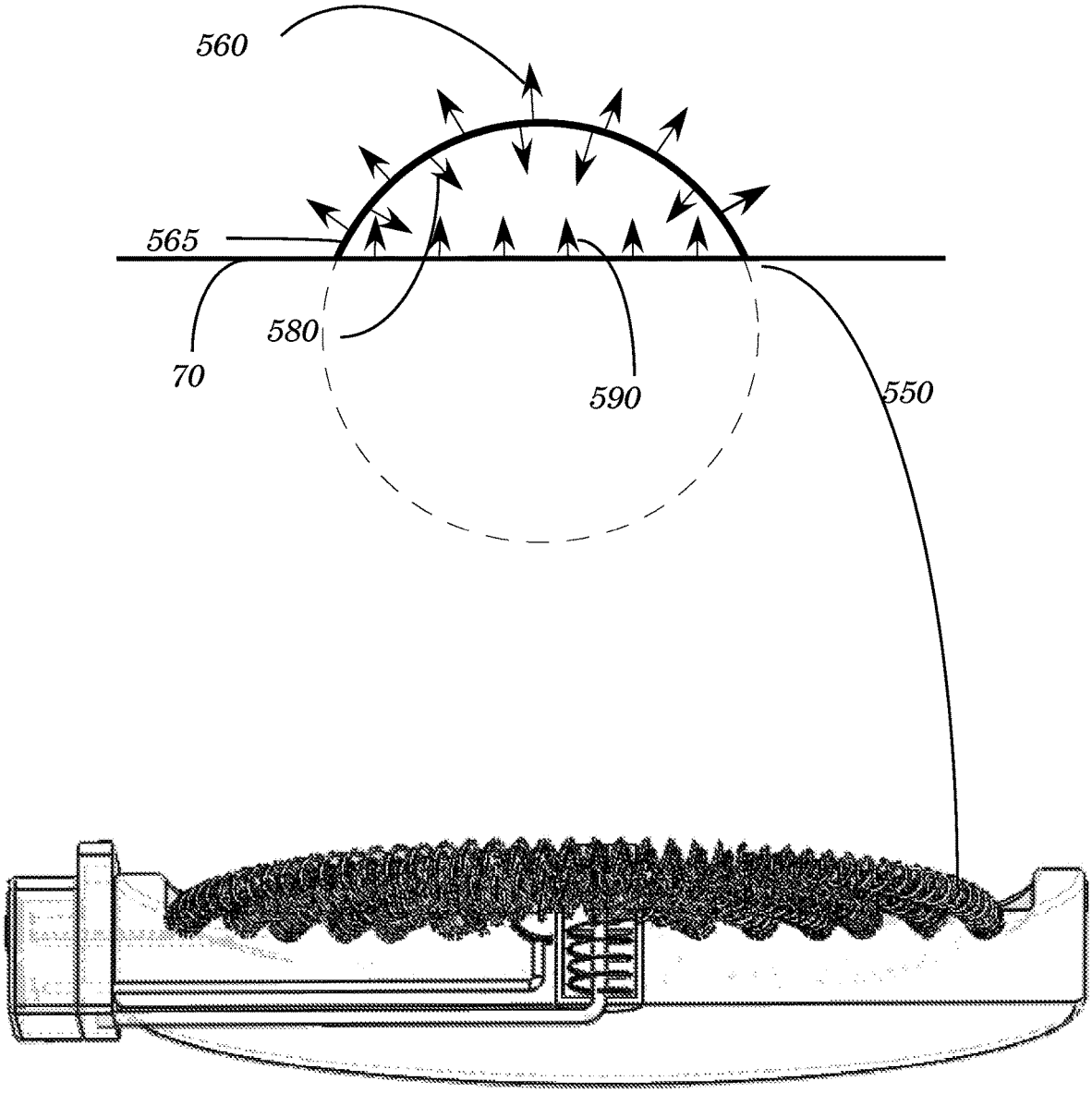
FIG. 6 details of the radiant energy emissions of the radiant element shown in FIG. 4.
Figures 1, 7:
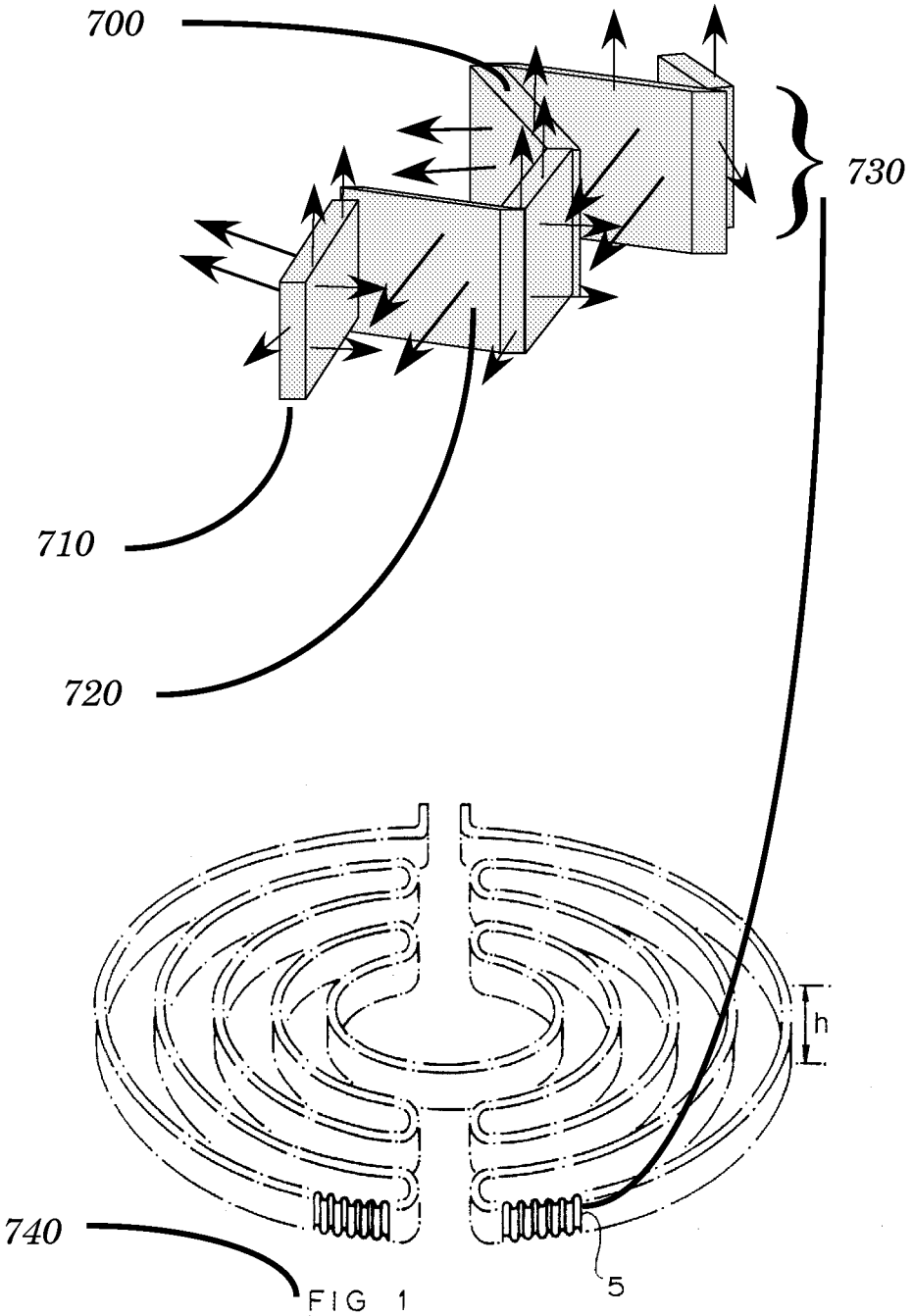
FIG. 7 reveals the thermal radiant emissions of the (resistive) elements in common use today, using a diagram from a previously issued U.S. Pat. No. 5,512,731.

The ceramic has been poured into a molded or machined ceramic refractory insulator 10 that is a minimum of about 18 mm or 0.75", or more typically 25 mm or 1" thick. This "shell" serves to provide a structure that can accept the over-mold of the castable ceramic that is used to cover the (resistive) radiant element. As can be seen in FIG. 4 item 165, machined grooves have been cut into the machinable refractory thermal insulator. The grooves 165 serve to assist manufacturing and the ceramic refractory 10 effectively minimizes the transmission of thermal energy from the embedded element to the space behind the radiant element.

Additionally a K, R or S thermocouple in a protective sheath of Inconel or Stainless Steel 132 is embedded in the castable ceramic 70 such that it is in contact 140 with an embedded near-center coil (see detail in cutout 200). The thermocouple 132 makes contact 140 at the maximum depth from the surface of the ceramic. The thermocouple leads 132 are brought out to the control module 120 through thermal isolation block 130.

The performance of these new radiant projectors is significant. The very limited exposure (approximately 30% of each coil is exposed outside of the ceramic) of the resistive wire coil segments 20 provides a restricted surface area from which the radiant energy created by the current flow through the (resistive) element can escape.

In this implementation, the ceramic matrix additionally provides physical support to most of each coil's radiant surface. This feature allows reliable operation above the plastic deformation temperature of the resistive element (e.g., the nickel chromium alloy or some resistive conductor chosen for its robust thermal performance). These superheated coil segments are light enough that surface tension becomes a factor enabling the coils to maintain their shape against gravity and thus overcome plastic deformation and nearly doubling the useful temperature range of the emitter.

This construction restricts the emission of the radiant energy to approximately one third of the (resistive) radiant element's surface area. The high performance castable ceramic refractory 70 quickly heats up to nearly the temperature of the radiant wire, minimizing the radiant transfer of energy to the ceramic, because only a portion of the (resistive) radiant element can "see" a lower temperature heat sink opportunity 20. By the Stefan-Boltzmann Law, the effectiveness of radiant energy transfer is proportional to the fourth power of the difference in temperature between the emitter and the receiver. This physical construction essentially restricts the exposed portions of the radiant element to be the only path for the thermal energy to exit the (resistive) radiant element 565.

Since less than half of the radiant surface of the (resistive) conductor through which the electrical current is flowing is available as a pathway for radiant energy release, the intensity or power per unit area is driven up to approximately double the typical operating (radiating) temperature for a given (resistive) element and a stated current flow.

At this time there is no comparable (resistive) radiant element constructed for any similar purpose that employs an embedded thermocouple 132 to enable the precise closed-loop control of the output wavelength (i.e., temperature) of the radiant energy produced. Isolation of a single partially exposed coil is presented in an exaggerated view 550 to show some detail of the relative emitting surfaces of the partially exposed coil. As indicated by 565, the exposed section of the radiant coil reveals projected radiant energy as a Lambertian Surface. A Lambertian surface emits radiant energy as a cosine function of the viewing angle normal to the surface; as such, more than 70% of the radiant energy released by this (resistive) element is projected within 45 degrees of normal to the element surface.

The embedded (resistive) element has about 33% of the coil exposed; 33% of 180 degrees (from the symmetry of half a circle) is about 60 degrees of total arc length. From the center of the exposed coil 560 directly towards the bottom of the cooktop 2, the coil extends downward about 30 degrees on each side. Thus, even at the extreme sides of the exposed coil, more than 70% of the radiant energy released by the (resistive) radiant element energy over the entire exposed arc length is hitting the bottom of the ceramic glass 2.

The radiant energy from the inner side of each coil 580 is exposed directly to the surface of the high thermal-capacity, low thermal-conductivity refractory material 70. The refractory quickly heats up and becomes a thermal energy radiator 590 at nearly the same temperature as the radiant element. Although the refractory material 70 is a significant insulator and as such actually conducts very little heat away from the element, by the Stephen-Boltzmann law it also couples very little heat into the material from the radiant element. But the radiant energy emitted secondarily and normal from the surface 70 is an effective radiator of high-temperature radiant energy towards the ceramic glass plate 2.

Figure 8:
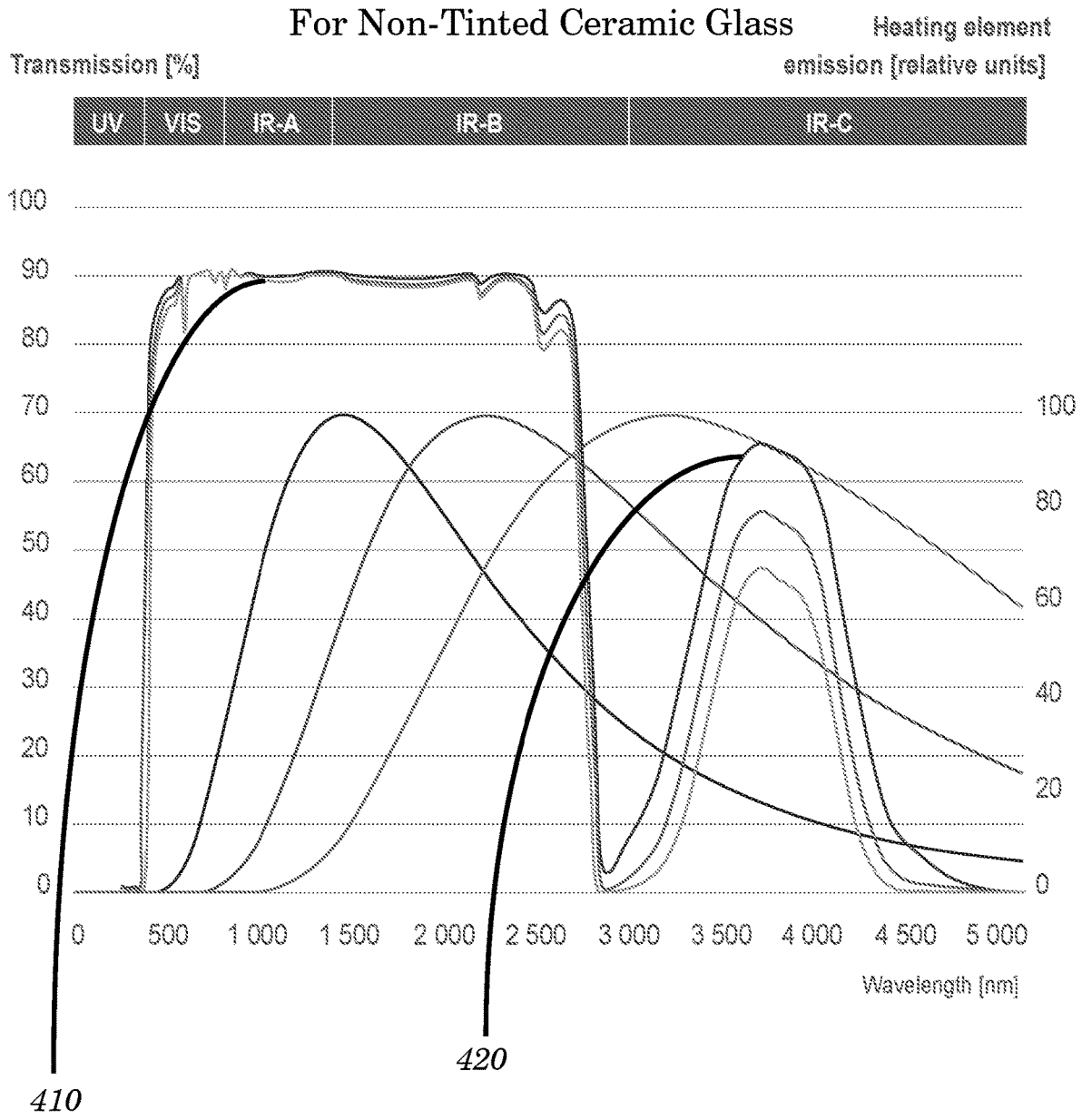
FIG. 8 is a transmission vs. wavelength plot for the non-tinted second generation of ceramic glasses as applicable to two major manufacturers.
Figure 9:
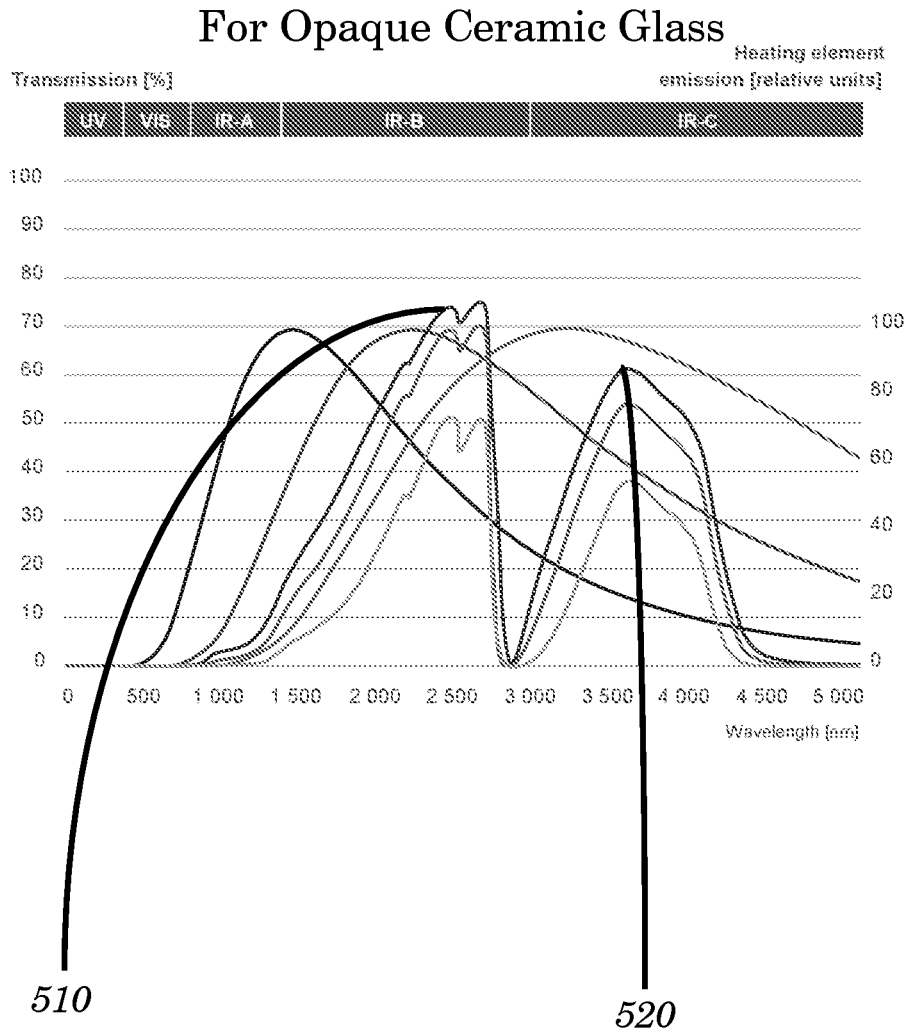
FIG. 9 is a transmission vs. wavelength plot for the highly opaque second-generation ceramic glasses typical of two major manufacturers.

The apparatus presented in this disclosure reveals a physical implementation of a (resistive) radiant coil that is embedded in a ceramic refractory such that the temperature range (i.e., wavelength) of the emitter is significantly extended and the embedded thermocouple enables a capability for variable, but precisely controlled, radiant energy output. This capability contributes to the optimum "tunability" of the radiant emitter 20 and enables the reliable method of creating a radiant source precisely "tuned" to the optimal passband 410 and 510 of the ceramic glass plate 2 as depicted in FIGS. 8 and 9. Another component of the control process addresses the concern for safety and overheating of the ceramic plate 3, where shielded thermocouple 134 is positioned by contact spring 150 to contact the underside of ceramic glass plate 3 at contact point 40. Machined insulating refractory 30 provides thermal isolation for shielded thermocouple 134 from the radiant energy of the (resistive) emitter 20. Contact spring 150 is thermally isolated from the machined ceramic shell 10 and castable ceramic 70 by the machined refractory thermal isolator 160, in order to make non-ambiguous temperature measurements of the ceramic glass cooktop 2.

Below details a process by which the cooking utensil 3 is optimally heated using thermal energy that largely passes through the ceramic glass 2, minimally heating the glass with absorbed energy. Thermocouple 134, through contact point 40, monitors the temperature of the ceramic glass 2 so that the control process can make adjustments to keep the ceramic glass in a safe operating range. It may seem counterintuitive, but raising the temperature of the radiant element 20 to produce shorter wavelengths that will largely pass through the ceramic glass, will deliver more heat to the cooking utensil 3 and put less wasteful heat into the ceramic glass.

The emitter source temperature can be controlled to optimize the transfer of radiant thermal energy and can be precisely controlled to regulate the heating effect on the cooking utensil 3.

A Method for Effecting Control of the Radiant Element, the Resulting Wavelength, the Heating of the Ceramic Glass and the Heating of the Cooking Utensil Many control computer systems, embedded or remote, could be programmed to effectively read the temperatures of the embedded thermocouples, relate them to the operations process using a predefined Temperature Map defined specifically for each ceramic glass model number and manage the radiant element through a solid state or mechanical switch. The Temperature Map relates the radiant energy dissipation vs transmission rates at different temperatures (e.g., wavelengths) vs time for various thermal energy delivery requirements (i.e., user input settings) to the cooking utensil.

The high temperature tunable radiant element 20 is shown with an attached embedded control processor module and switching system (control module) 120. It should be noted that although this implementation provides advantageous features in the control of the tunable emitter, it is not a critical or limiting factor in the application of the tunable radiant element.

A conventional embedded computer control system has been developed specifically to enable such consumer and industrial processes which would benefit from this embedded radiant emitter. This embedded control system is optimized for the precise control of high performance radiant heating where safeguards for human life, equipment and facilities are of concern. The embedded controller includes a zero dissipation switch under the control of an embedded microprocessor, which continually monitors the several sensor lines including a thermocouple embedded in the tunable cooktop radiant element and a thermocouple pressed against the bottom of the ceramic glass cooktop. This microprocessor is programmed with the parameters of the passbands and the critical safe operational limits for the ceramic glass of any specific generation. Additionally, the controller provides Ground Fault Interruption and Arc Fault Interruption, as well as maximum current limit circuit interruption. Details of the zero dissipation switch and embedded controller are revealed in U.S. Patent Provisional application No. 62/325,678.

The following describes a control process carried out in accordance with the present invention for delivering thermal energy to a cooking utensil 3 sitting on top of a smooth ceramic glass cooktop 2. It should be understood that this aspect of the present invention is not limited to the apparatus described herein. Practice of the process described below with other apparatuses for providing precise wavelength-controlled thermal energy is considered to be within the scope of the present invention.

Figure 3:
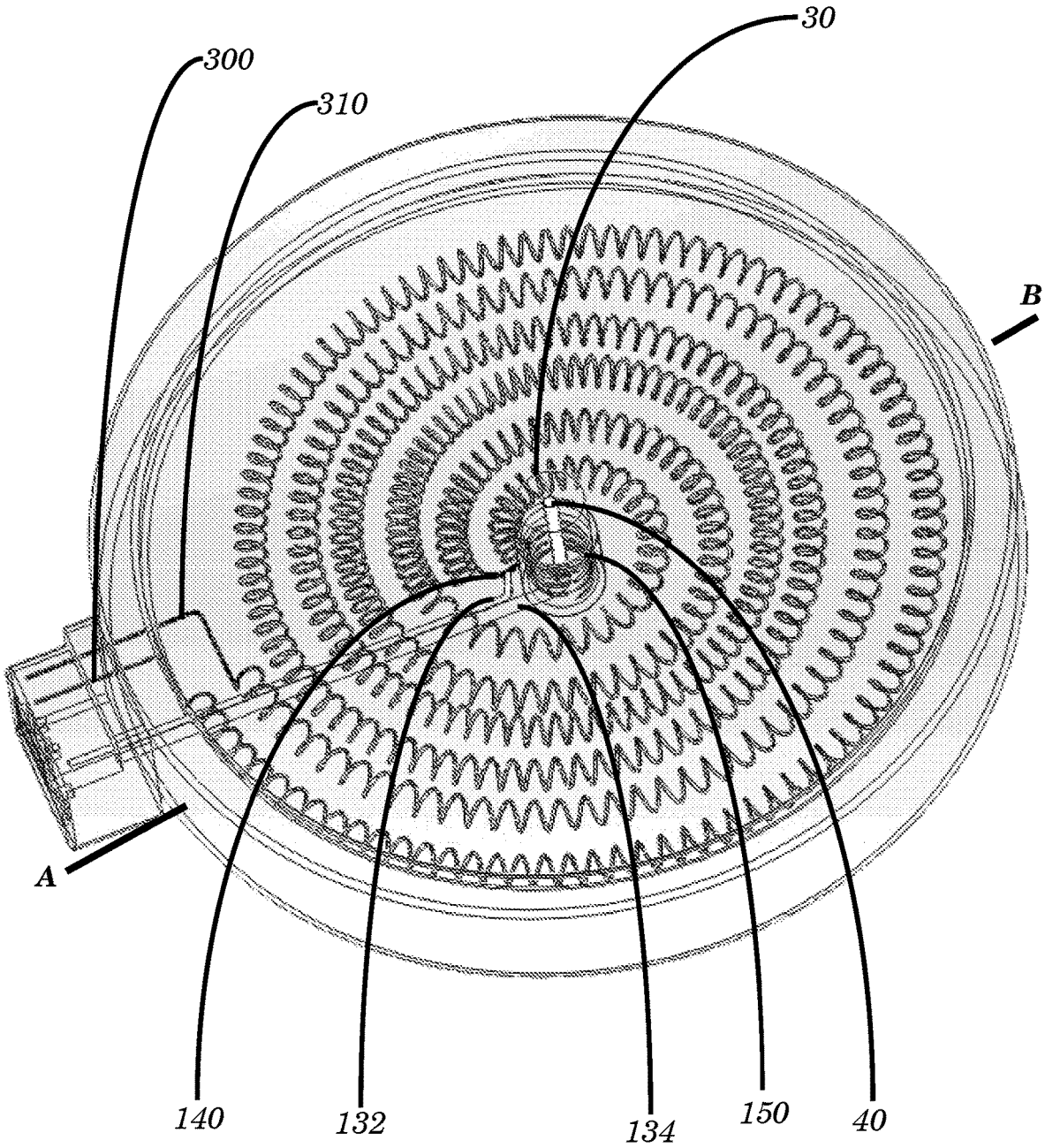
FIG. 3 is a top plan view of an element with the castable ceramic refractory removed to reveal the embedded routing of the element filament and the fitment of the thermocouples and their positioning and heat shielding systems.
Figure 10:
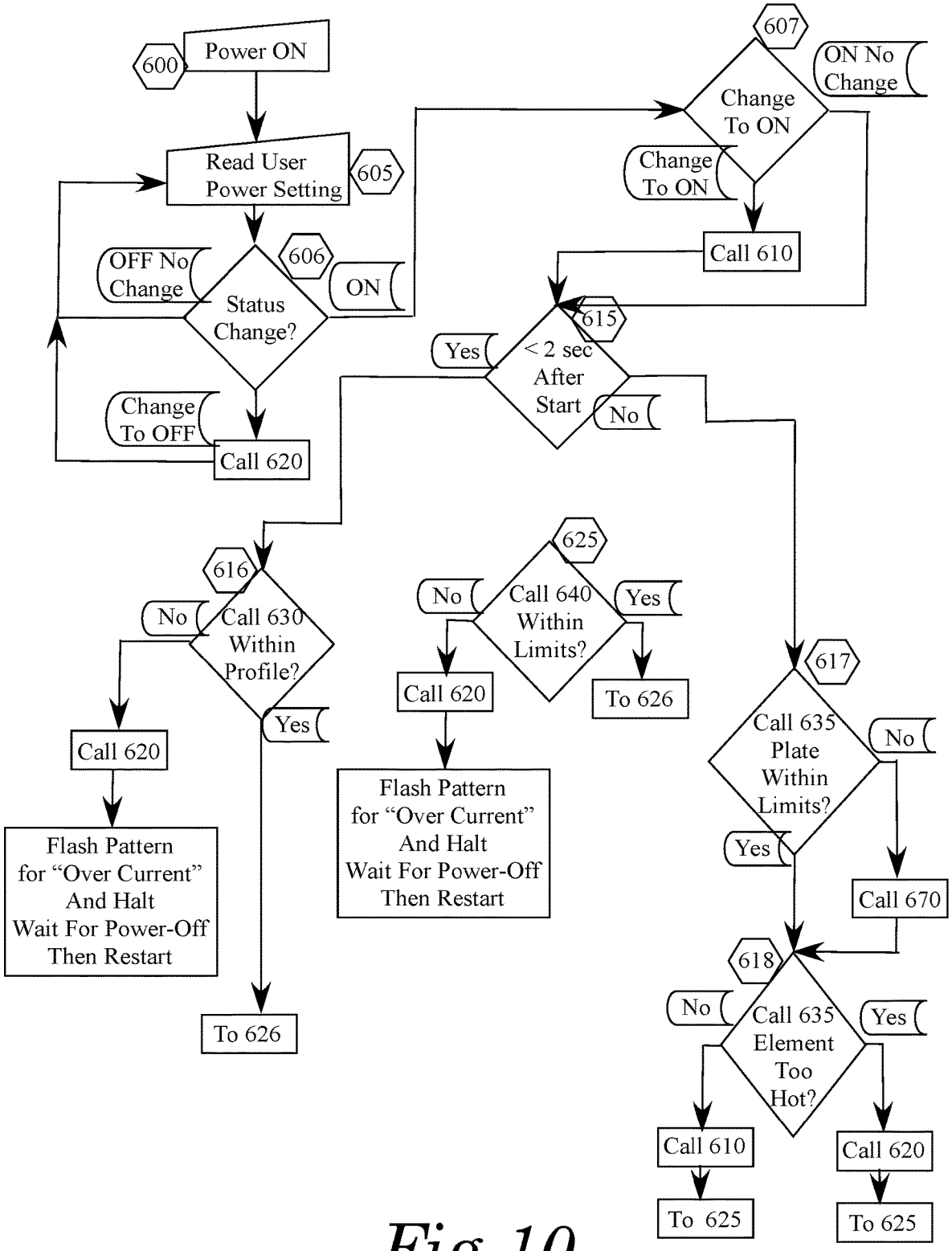
FIGS. 10 and 11 are process flow charts for a proposed method for controlling a tunable emitter to optimize the thermal energy emission through the ceramic glass to the cooking utensil.
Figure 11:
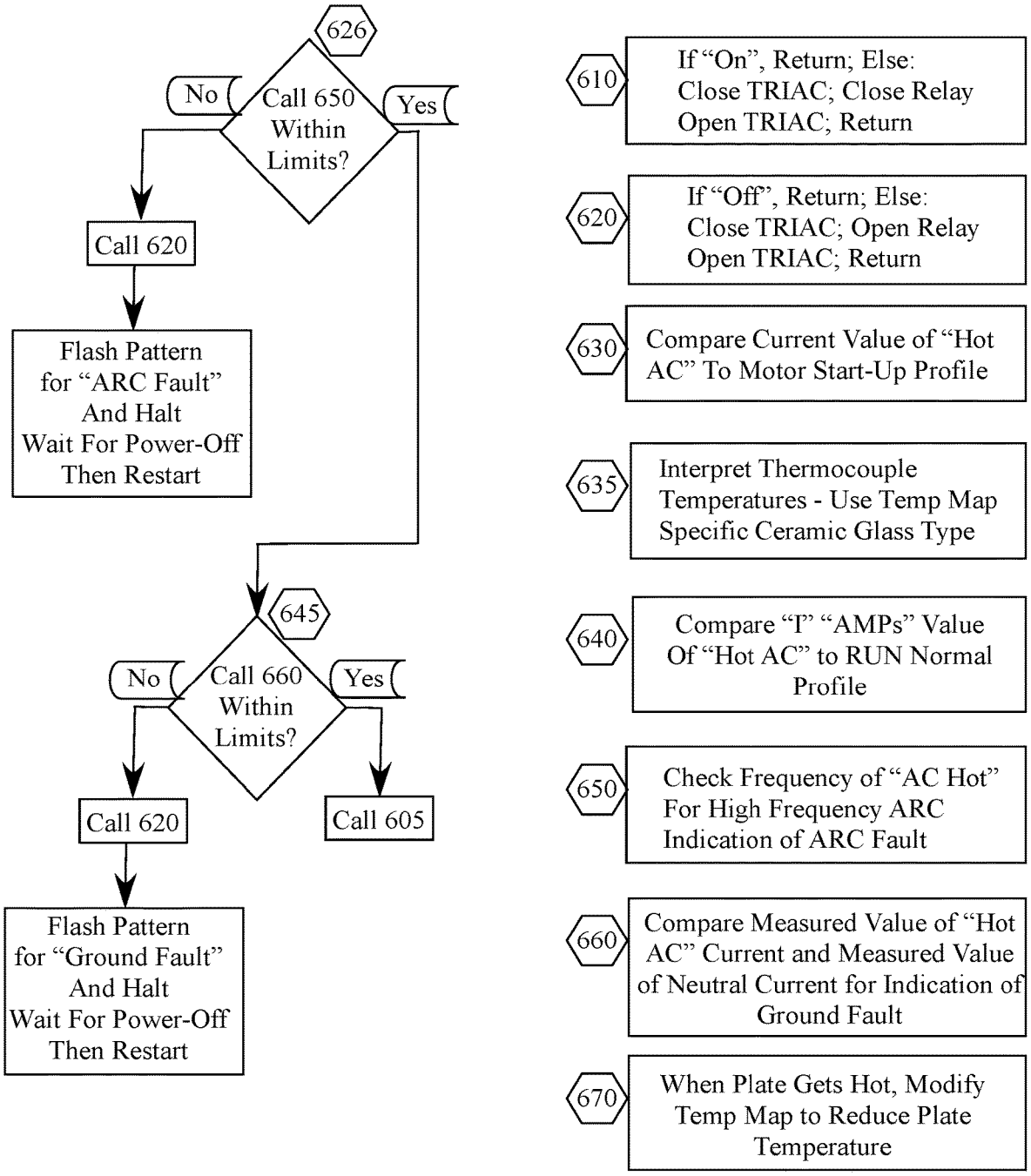

As best illustrated in FIGS. 2 and 3, AC power is applied at the connector 50 and the connection to the local user interface control system 60, and is passed through the control module and switching device 120 to leads 300 and 310 to power the (resistive) element. As shown in FIG. 2, power is applied to the control module 120 when the Smooth Top Cooking Range, in which this embodiment is housed, is connected to utility power. When power is applied, the control module 120 runs a continuous loop process as depicted in FIGS. 10 and 11, with starting point at Power On 600. In FIG. 10, processes 605 and 606 constantly monitor the user input settings on the control panel of the appliance. When process 606 detects a change to "On", process 607 is called to manage the user command. Process 610 is called to condition the zero dissipation switch to power the element, Process 615 allows for a specific startup current profile to operate for 2 seconds, accommodating current in-rush opportunities if the circuit has been programmed for such considerations. Process 616 calls process 630, which evaluates the current draw for adherence to the 2-second current ramp profile. If no special current profile is loaded into the operating program by the factory, then this current profile is executed against the "typical" or "standard" current profile. If the current draw is NOT within the profile, then process 620 is called to shut down this channel, an error or fault pattern is transmitted to the control computer and an error pattern is flashed on the LEDs 51, 61 mounted on the control module 120.

If the current draw is within the profile, then the program loop continues on to process 626 which calls the "ARC Fault" program process 650. If there is an ARC Fault, then the program shuts off the radiant element, transmits the fault identification to the control computer and then flashes the ARC Fault pattern on the LEDs 51, 61 on the control module 120.

If there is no "ARC Fault", then the loop proceeds to process 645 which calls process 660 to test Ground Faults. If a "Ground Fault" is detected then the system calls process 620 to shut down this radiant element, notify the control computer of the fault condition and flashes the "Ground Fault" error code on the LEDs 51, 61 on the control module 120. If there are no "Ground Faults" then the control loop returns to process 605 and repeats until the first 2 seconds of run time have passed.

The first time the program loop arrives at process 605 after the 2-second timer has run down, the program loop will branch at process 615 to 617 where the tracking of the thermal profile of the ceramic glass plate is constantly monitored to be within the Temperature Map based on the specific type and model number of the ceramic glass incorporated in this particular smooth top cooking range or counter top.

If the ceramic glass plate 2 is measured to be out of the acceptable range, then process 670 is called. Process 670 will modify the radiant emitter or "element" Temperature Map to reduce the thermal energy dissipated in the ceramic glass top 2. For either branch of process 617 the program loop moves to process 618 where process 635 is called to compare the radiant element Temperature Map to the measured values and the user input to ensure that the cooking utensil 3 sitting on top of the cooktop 2 is getting the thermal energy anticipated by the user with respect to the user's request, indicated by the heat range selected by the user at the user input device.

Process 635 will cause the program loop at 618 to branch to either turn the element "On" at process 610, or keep it "On" if it is already "On", if it is operating within the Temperature Map; or process 635 will cause the program to branch at 618 to process 620 to turn the radiant element "Off", or keep it "Off", if the temperature of the element is still too high as compared to the operating Temperature Map. This is the portion of the control loop that will constantly toggle the radiant element 1 on and off for milliseconds at a time to hold the temperature of the radiant element at the desired level.

After program element 618, and the call to either process 610 or 620, the loop will flow to process 625 to call process 640 to test the circuit for excessive current draw for the conditions and operating parameters. If there is an over-current condition, process 620 is called to cut off all power to the radiant element, send a fault indication to the control computer and flash the "Over Current" error condition on the LEDs items 51 and 61 on the control module 120.

If the radiant element is not drawing excessive current then the control loop will move on to process step 626 to perform the ARC Fault test. If there is an ARC Fault, then the system will process 620 to terminate all power to the radiant element 1, send a fault message to the control computer and flash the ARC Fault error code on LEDs 51 and 61 on the control module 120.

If the control loop finds the ARC Fault frequency within limits the control loop moves on to process 645, where process 660 is called to evaluate the current flow on both the AC Hot and AC Neutral lines to determine a Ground Fault. If the two current flows are within the specified parameters, then the system will return control to the initial process element 605. But if the system does detect a Ground Fault as a safety measure to ensure that there are no life safety issues with the radiant element process, 620 will be called, a fault message will be sent to the control computer and a Ground Fault error code will be flashed on the LEDs 51 and 61 on the control module 120.

The invention claimed is:

1. An infrared heating apparatus comprising:

a sheet of ceramic glass having a passband in the infrared spectrum;

a metal resistive element having a first portion that is covered by a ceramic refractory material and a second portion that is exposed by the ceramic refractory material; and a controller that controls the metal resistive element to emit infrared radiation in a wavelength corresponding to the passband of the ceramic glass, wherein the metal resistive element is a coil, and at least a portion of the ceramic refractory material is disposed within a central void of the coil.

2. The infrared heating apparatus of claim 1, wherein, when current is supplied to the metal resistive element, more than 70% of radiant energy from the metal resistive element contacts the ceramic glass.

3. The infrared heating apparatus of claim 1, further comprising:

a temperature sensor coupled to the ceramic glass, wherein the temperature is configured to control an amount of heat provided to an object on the ceramic glass based on a combination of radiant heat from the resistive element and conductive heat from the ceramic glass.

4. The infrared heating apparatus of claim 1, wherein the metal resistive element is a coil, a lower portion of the coil is enclosed by the ceramic refractory material, and an upper portion of the coil is exposed by the ceramic refractory material.

5. The infrared heating apparatus of claim 1, wherein the ceramic refractory material provides sufficient support to the metal resistive element such that the metal resistive element retains its shape when raised to a temperature at which a liquid phase is present in the metal material.

6. The infrared heating apparatus of claim 1, wherein the passband is characterized by wavelengths shorter than 2,700 nm and longer than 500 nm.

7. The infrared heating apparatus of claim 1, wherein the controller is configured to heat the metal resistive element to a temperature above 800° C.

8. The infrared heating apparatus of claim 1, wherein the infrared heating apparatus is a cooktop stove.

9. A method of heating an object using infrared energy, the method comprising:

heating a metal resistive element that is partially embedded in a ceramic refractory material to emit infrared energy having a first wavelength; and passing the infrared energy having the first wavelength through a sheet of ceramic glass that has a passband corresponding to the first wavelength, wherein the metal resistive element is heated to a temperature above 800° C.

10. The method of claim 9, wherein the metal resistive element is heated to a temperature at which at least a portion of the metal is in a liquid phase.

11. The method of claim 9, wherein the metal resistive element is heated to a temperature at which a shape of the metal resistive element is retained by surface tension.

12. The method of claim 9, wherein more than 70% of radiant energy released from the metal resistive element contacts the sheet of ceramic glass.

13. The method of claim 9, further comprising:

controlling an amount of heat provided to an object on the ceramic glass based on a combination of radiant heat from the resistive element and conductive heat from the ceramic glass.

14. The method of claim 9, wherein the passband is characterized by wavelengths from 2,700 to 500 nm.

15. The method of claim 14, wherein the first wavelength is from 2,700 nm to 500 nm.

16. The method of claim 9, wherein the object is a cooking vessel.

17. An infrared heating apparatus comprising:

a sheet of ceramic glass having a passband in the infrared spectrum;

a metal resistive element having a first portion that is covered by a ceramic refractory material and a second portion that is exposed by the ceramic refractory material; and a controller that controls the metal resistive element to emit infrared radiation in a wavelength corresponding to the passband of the ceramic glass, wherein the controller is configured to heat the metal resistive element to a temperature above 800° C.

18. A method of heating an object using infrared energy, the method comprising:

heating a metal resistive element that is partially embedded in a ceramic refractory material to emit infrared energy having a first wavelength; and passing the infrared energy having the first wavelength through a sheet of ceramic glass that has a passband corresponding to the first wavelength, wherein the metal resistive element is heated to a temperature at which at least a portion of the metal is in a liquid phase.

* * * * *